United States Patent [19]

Satterwhite

[11] 3,946,468

[45] Mar. 30, 1976

[54] METHOD OF PRODUCING TEXTURED YARN

[75] Inventor: Fred B. Satterwhite, Williamsburg, Va.

[73] Assignee: K. M. G. Machinery Limited, Macclesfield, England

[22] Filed: June 6, 1969

[21] Appl. No.: 831,111

Related U.S. Application Data

[63] Continuation-in-part of Ser. No. 532, 642, March 8, 1966, Pat. No. 3,454,998, and Ser. No. 673,554, Oct. 9, 1967, abandoned, which is a continuation-in-part of Ser. No. 586,437, Oct. 13, 1966, abandoned.

[52] U.S. Cl. ..... 28/72.11; 28/1.3; 28/1.6; 28/72.14

[51] Int. Cl.[2] ..... D02G 1/20; D02G 1/12

[58] Field of Search..... 57/34 HS, 34 B, 140 BY, 57/157 TS, 157 MS, 157 F; 28/1.2, 1.3, 1.4, 1.5, 1.6, 72.1–72.17, 62, 71.3

[56] References Cited

UNITED STATES PATENTS

| | | | |
|---|---|---|---|
| 2,611,923 | 9/1952 | Hume | 28/71.3 X |
| 2,942,325 | 6/1960 | Spellman, Jr. | 28/71.3 X |
| 2,977,663 | 4/1961 | Evans | 28/62 |
| 3,061,998 | 11/1962 | Block | 57/140 BY |
| 3,199,281 | 8/1965 | Maerov et al. | 57/140 BY |
| 3,200,576 | 8/1965 | Maerov et al. | 57/140 BY |
| 3,234,624 | 2/1966 | Shattuck | 28/1.6 |
| 3,255,580 | 6/1966 | Garner et al. | 57/140 BY |
| 3,302,385 | 2/1967 | Ruddell et al. | 28/72.17 X |
| 3,444,681 | 5/1969 | Reese | 28/72.17 X |
| 3,454,998 | 7/1969 | Satterwhite | 28/1.6 |
| 3,781,952 | 1/1974 | Stanley | 28/1.6 |

FOREIGN PATENTS OR APPLICATIONS

| | | | |
|---|---|---|---|
| 658,465 | 5/1965 | Belgium | 28/1.3 |
| 1,029,097 | 5/1966 | United Kingdom | 28/72.11 |
| 1,064,765 | 4/1967 | United Kingdom | 28/1.3 |

*Primary Examiner*—John Petrakes
*Attorney, Agent, or Firm*—Nolte and Nolte

[57] ABSTRACT

Textured yarn filaments having predetermined texture development characteristics are combined with other textured yarn filaments having different crimp development characteristics. A yarn made by such a process in which those filaments having lesser crimp development lie generally toward the outside of the yarn. Non-rowy carpeting is made by tufting or weaving this yarn into a backing and then further developing the crimp. Apparatus for making such yarn including means for simultaneously heating and producing different crimp development characteristics in two or more ends of yarn.

5 Claims, 11 Drawing Figures

INVENTOR.
FRED B. SATTERWHITE
BY
Nolte & Nolte
ATTORNEYS

INVENTOR
Fred B. Satterwhite
BY
Nolte & Nolte
ATTORNEYS

INVENTOR.
FRED B. SATTERWHITE

BY

Nolte & Nolte
ATTORNEYS

METHOD OF PRODUCING TEXTURED YARN

This application is a continuation-in-part of application Ser. No. 673,554, filed Oct. 9, 1967, now abandoned which, in turn, is a continuation-in-part of application Ser. No. 586,437, filed Oct. 13, 1966, now abandoned. This application is also a continuation-in-part of application Ser. No. 532,642, filed Mar. 8, 1966, now U.S. Pat. No. 3,454,998.

This invention relates to yarn and to methods for treating yarns having a thermoplastic component, such as nylon, polypropylene and polyester, and particularly to the production of textured yarn having extremely good bulk characteristics.

The invention contemplates the production of such textured, high bulk yarn having desirable dye acceptance characteristics.

It is general object of the invention to impart a differential in crimp development as between at least two portions of filaments within a yarn.

It is an object of the invention to combine two ends of yarn, each having different crimp development characteristics and to "blend" the filaments of the two ends to form a single yarn. Within this context of the invention, a continuous process for treating the yarn ends on the run is contemplated, and in which the ends are combined and texturized, and within which a differential in crimp development is imparted to the separate ends.

The invention contemplates the combining of two or more ends at least one of which has different crimp development characteristics than those of the others.

The differential in crimp development characteristics as between yarn ends can be imparted to the ends in various ways, including imparting to the ends different heat histories prior to texturizing, applying different pressure to the two ends during texturizing, orienting by drawing one yarn more than the other prior to combining, and shrinking one yarn more than the other prior to combining. In the specific embodiment of the invention to be described, heat differential in the initial steps of the process is used.

It is believed that as a result of the imparting of different heat histories as between the different yarn ends, a differential in shrinkage characteristics and crimp development within the combined and texturized yarn results. That is, one portion of the combined texturized yarns so treated contracts more than the other portion due to higher crimp development and will also, under heating temperatures acceptable for preheating before texturizing, have higher shrinkage characteristics than the other. It is further believed that the filaments with the higher heat history will have more texture, that is, will have a higher crimp memory and development and that therefore, the final yarn will have filaments with more than one shrinkage or crimp memory and that the filaments with the highest shrinkage or crimp memory will contract and force the other filaments to the exterior of the yarn.

Whatever the fact may be, the method produces a yarn with more bulk than if each filament had the same crimp parameters (i.e., amplititude and frequency). This appears particularly so with nylon yarn.

In the case of yarns, such as nylon 6 or nylon 66, the method of invention may also be utilized to produce a very high bulk yarn having more than one level of dye affinity. That is, the filaments exposed to sufficiently higher heat will not dye as darkly as the portion of the yarn having the lower heat history, and resultingly, the yarn when dyed will take on a tone on tone appearance.

It is, therefore, within the objects of the invention, to provide a single end texturized yarn having relatively high bulk characteristics and in which there is a differential between the contraction characteristics of one portion of the filaments of the yarn and another portion of the filaments of the yarn.

While it can be appreciated that the contraction or shrinkage differentials can be achieved in various ways, in accordance with one aspect of the present invention, two yarns of multi-filament yarn are heated, one of the ends being heated to a greater extent than the other and while on the run, the ends of the yarns are combined by joining and are directed into the crimping zone of a stuffer box crimper, for instance. As the two ends are joined and crimped together, they lose their individual identity. Because of the preceding heating step in which the two ends received different histories, the filaments of the yarn which had been heated more will receive a higher crimp memory and development. The yarn, which has now been combined and crimped presents itself as a single end as it merges from the texturizing step and because of the differential in contraction of the filaments, exhibits a very high degree of bulk. It may be desirable as a next step, to entangle the filaments within the now combined single end yarn to render the total bundle of filaments in the yarn more compact and thus, more amenable to subsequent processing. This is particularly desirable where the yarn being processed has little or no twist. In this respect, filament entanglement via air under pressure, such as the technique disclosed in my copending application Ser. No. 586,491, filed Oct. 13, 1966, and now U.S. Pat. No. 3,501,819 entitled "YARN PROCESSING METHOD AND APPARATUS", has been found acceptable.

It is contemplated by this invention to provide a continuous process in which the yarn is drawn, heated, or drawn and heated simultaneously, in such a manner so as to impart different histories to the two ends of yarn, and then to texturize the yarn immediately after heating. In this respect and in accordance with one aspect of the invention, the use of a pair of driven godets about which two ends of initially unoriented yarn are wound and between which they are drawn have been used. Both ends are wound upon the first godet, which is heated, with one of the ends being caused to reside on the first godet through more turns than the other. Both ends are then led to the next godet, which may also be heated, and about which the ends are wound and which is caused to be driven at a greater rate of speed to thereby orient the yarn. The now oriented ends, one of which has been heated more than the other are then combined, by joining on the run, as they are fed into crimping apparatus. Advantageously, after crimping the now single end, the joined ends, for all intents and purposes having lost their individual identity, may be permitted to heat set for better retention of the crimp imparted in the texturizing step, after which it may be permitted to cool and/or relax. Whatever the procedure may be after crimping, one portion of the filaments of the now single end of yarn have a different crimp development than the other portion. Advantageously, the filaments may now be entangled to impart to the final product a compactness rendering the yarn more suitable for further processing such as tufting, weaving and the like.

The yarn product of the invention, as will be appreciated consists of two definitive portions of filaments, one having a higher crimp development than the other with the filaments having the lesser development generally lying toward the outer surfaces of the yarn. After the filament entanglement step the entire bundle of filaments are intertwined and present a compact yarn having surprisingly high bulk characteristics.

According to another aspect of the invention the combined yarn may be made into the pile of carpeting by conventional techniques, viz., tufting or weaving. The crimp in the yarn may then be further developed as, for example, by dyeing the carpeting. The result attained is unique. Prior to the further development of the crimp, the pile of the carpeting exhibits what may be referred to as "rowiness," which is characteristic of much carpeting. Specifically, the surface appearance of the pile is characterized by very marked alignment of the tufts in rows. This is due to the fact that, of course, the tufting machine or loom constructs the tufts in a pattern constituted of a series of rows and, moreover, the tufts are standing entirely upright causing this row pattern to appear on the surface of the pile.

In the manufacture of carpeting according to the invention, the above described differential contraction occurs in each of the tufts, and it is found that this not only causes the filaments of the end having the lower heat history, and consequently undergoing less contraction and crimp formation, to be pushed to the exterior portion of each of the tufts but, moreover, the differential contraction and crimping causes the tufts to bend randomly from their former orientation normal to the backing of the carpeting. By virtue of this phenomenon, carpeting according to the invention has a pile of a particularly esthetically pleasing surface appearance in which the upper portions of the tufts visible at the surface of the pile are in a random pattern rather than in rows. Moreover, the same effect may be achieved by the same means in the manufacture of any fabric constructed by weaving, knitting or any other method conventionally employed to produce pile fabric.

Another feature of the invention is that with the use of conventional minor quantities of conventional delustrants for carpeting yarn, e.g. 0.2% by weight, based on the weight of the yarn, of $TiO_2$, a degree of luster can be obtained in carpeting according to the invention different from that obtained employing the same quantities of the same delustrants in the yarn constituting the pile of conventional carpeting. Specifically, according to the invention it is possible to obtain higher luster for a given degree of bulk than in the prior art. It is thought that this may be explained as follows.

Normally, a more highly crimped and, consequently, bulkier yarn of a given composition has less luster than a less crimped and bulky yarn. The crimps diffuse the light and thus lower the luster. In the present invention, while high bulk is obtained, the filaments at the surface of the composite yarn derive from the end with the lower level of crimp, whereby the carpeting pile is more lustrous. The same would apply with respect to other pile fabrics.

The invention is applicable to polymer yarns of the continuous multi-filament type and can also be envisioned as being applicable to multi-filament yarns which have been fibrillated from film.

The invention will be more fully understood upon reconsideration of the ensuing specification and accompanying drawings in which.

Figure 5:
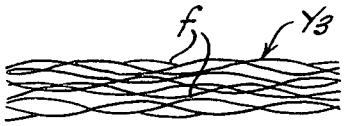
FIG. 5 is a diagrammatic view of texturized yarn in which all the filaments have the same crimp characteristics.
Figure 5A:
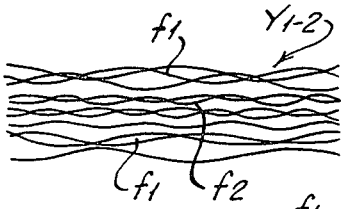
Figure 5B:
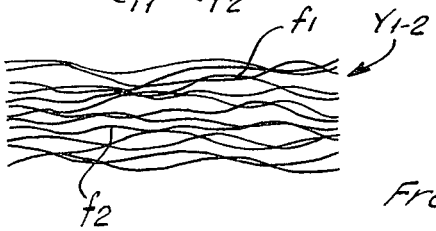
Figure 6A:
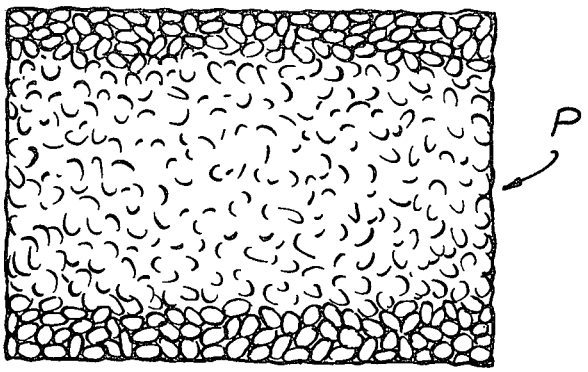
Figure 6B:
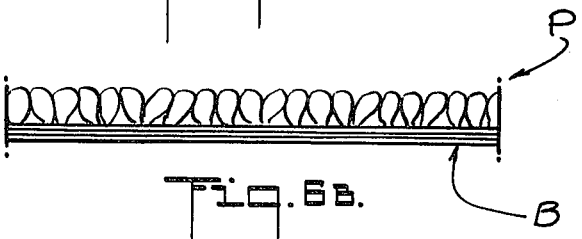
Figure 7A:
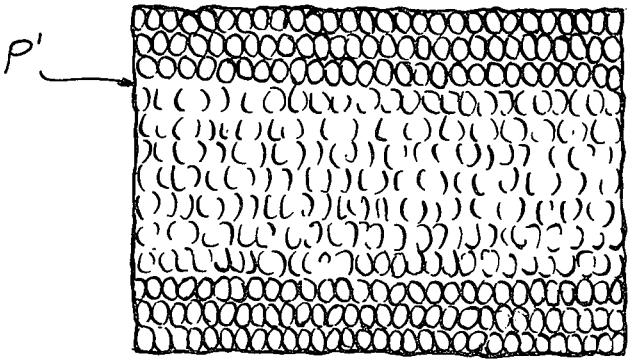
Figure 7B:
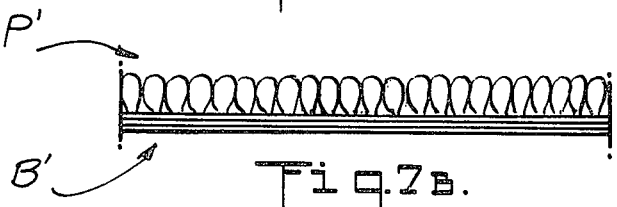

FIG. 5*a* is a diagrammatic view of yarn processed in accordance with the invention;

FIG. 5*b* is a diagrammatic view of the yarn of FIG. 5*a* after the filaments have been entangled;

FIGS. 6*a* and 6*b* are plan and side views, respectively, of carpeting according to the invention; and FIGS. 7*a* and 7*b* are plan and side views respectively, of carpeting of the prior art.

Referring to the yarn processing apparatus 10 of FIGS. 1 – 4, "raw" unoriented and untexturized continuous multi-filament yarn $Y_1$ having a thermoplastic component is taken off supply package $P_1$ supported on the open ended cylindrical package support 12 of apertured plate 11 and led through guide and tensioning device 15.

At the same time, raw unoriented and untextured yarn $Y_2$, of the same polymer and denier as yarn $Y_1$, is taken off supply package $P_2$ supported on the package support 13 of plate 14 and led through guide and tensioning device 16.

From the guides 15 and 16, yarns $Y_1$ and $Y_2$ are led to driven roller or godet 17 and its associated yarn positioner idler roller 18 around which the yarns are wound and from whence they are led to and wound around driven roller or godet 19 and its associated yarn positioner idler roller 20 prior to the yarns being joined and crimped.

Godet 17 is heated electrically by heater elements and according to desired results and yarns used, etc., godet 19 may also be heated. In the instance being discussed, the peripheral speed of godet 19 may be between 2 and 4 times faster than the peripheral speed of godet 17 whereby yarns 1 and 2 are oriented between the two godets. For specific details of construction and operation of the godets, reference is made to my copending application, Ser. No. 532,642, filed Mar. 8, 1966, now U.S. Pat. No. 3,454,998.

Figure 1:
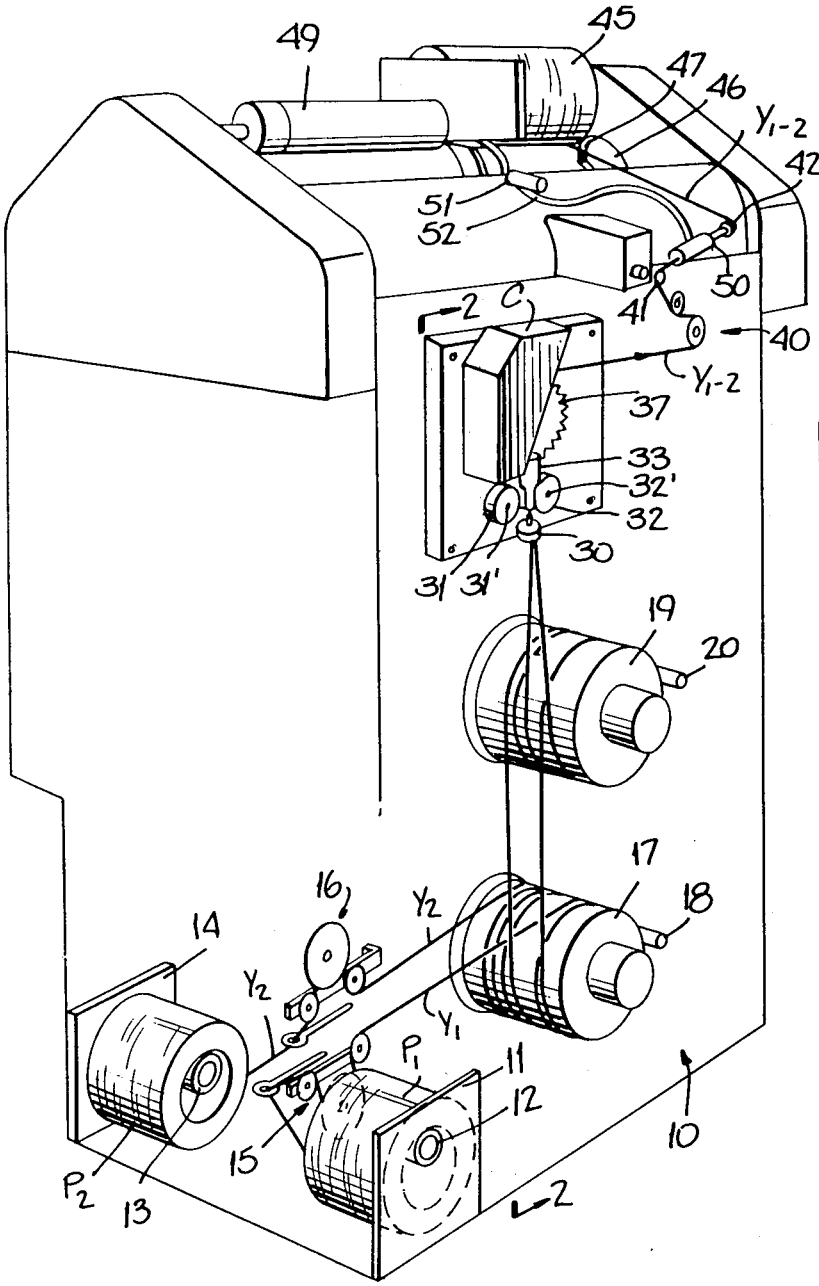
FIG. 1 is a perspective view of apparatus used in the method of the invention.
Figure 2:
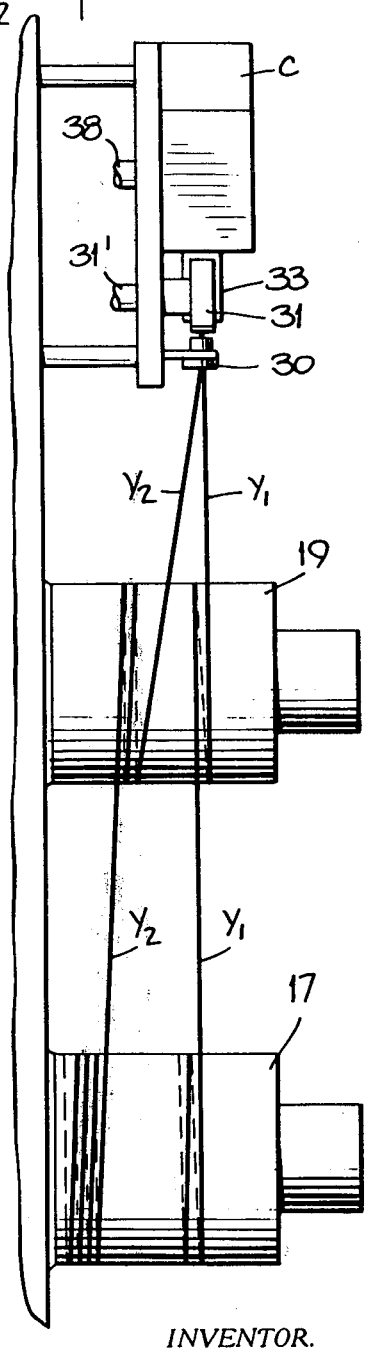
FIG. 2 is a side elevational view taken along the lines 2 — 2 of FIG. 1.
Figure 3:
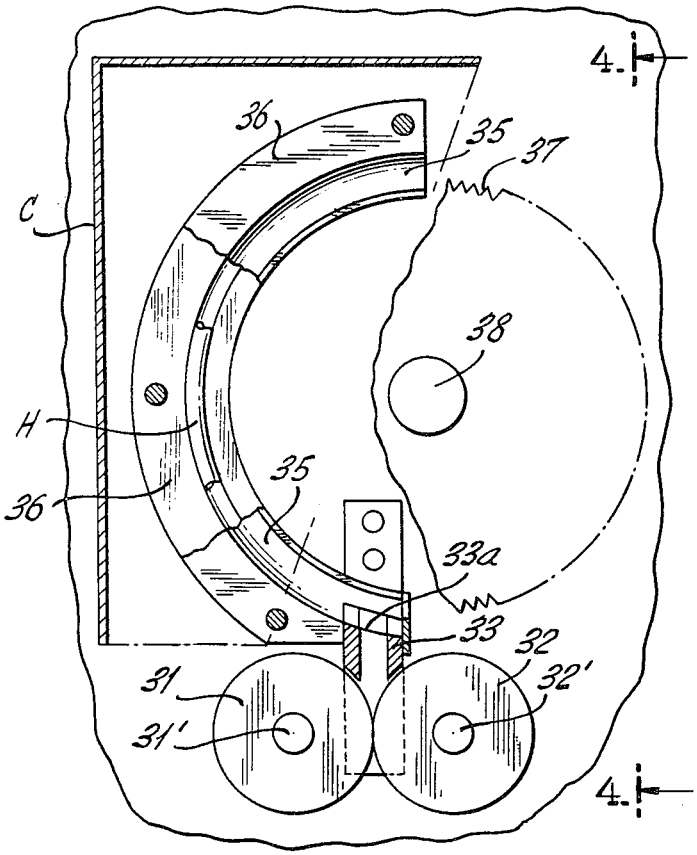
FIG. 3 is a partially diagrammatic, partially broken away elevational view of the crimping portion of the apparatus of FIG. 1.
Figure 4:
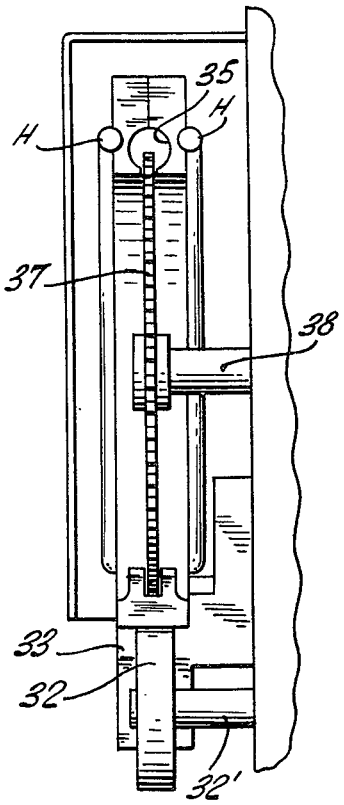
FIG. 4 is an end view taken along the line 4 — 4 of FIG. 3.

As best seen in FIGS. 1 and 2, yarn $Y_1$ is caused to be wound around godet 17 two turns while yarn $Y_2$ is caused to be wound around godet 17 four turns, thus providing a longer residence upon the heated godet for yarn $Y_2$ to thereby impart to that yarn a greater amount of heat than that imparted to yarn $Y_1$. Similarly, yarn $Y_1$ is shown to be wound around godet 19 one turn while yarn $Y_2$ is shown as having been wound around godet 19 two turns, so that in both instances, where godet 19 is heated, a further longer heated residence is given yarn $Y_2$ to either retain or increase the differential in heat history between the two yarns prior to crimping.

The yarns $Y_1$ and $Y_2$ having now been heated are ready to be crimped and to this end, they are led through guide 30 where they are combined by joining just prior to being fed through the nip of driven rollers 31, 32, which are driven via shafts 31′, 32′. Rollers 31 and 32 form a portion of the lower end of crimping chamber 33 where the yarn is crimped via linear compression.

Crimping chamber 33 communicates at its upper end, at 33*a*, (FIG. 3) to arcuate passage 35 of arcuate member 36 situated under cover C. The toothed periphery of wheel 37 driven via shaft 38 carries the crimped yarn, now in the form of a plug, through the arcuate passage 35. Arcuate member 36 may be heated by heaters H, in order to retain or implement the heat imparted to the now single end of yarn in the previous step where the two ends of yarn were heated, thus, providing a zone through which the plug of crimped yarn is transported with substantially no slippage and without changing the characteristics of the crimped yarn enabling the yarn to set or heat set, as the case may be.

The now heated, oriented and crimped yarn $Y_{1-2}$ is taken from the head of the plug and led through guide and tensioner apparatus 40, through guide 41, through the filament entanglement zone, through guide 42 onto take-up package 45, which is driven via drive roller 46. The yarn is laid back and forth upon package 45 via traversing mechanism 47.

In the apparatus shown in FIG. 1, means are provided for transferring the yarn being taken up from package 45 to a second take-up package 49 after package 45 is completed. These mechanisms form no part of the present invention.

As the yarn passes through the filament entanglement zone, it is caused to pass through an air nozzle 50 to which air under pressure is fed via valve 51 and conduit 52. It is here that the filaments of the yarn $Y_{1-2}$ are entangled. The details of operation and construction of the filament entanglement device are disclosed in my above referred to copending application Ser. No. 586,491 entitled "YARN PROCESSING METHOD AND APPARATUS" so that it should suffice to say here that in the nozzle 50 there is provided a passage for the yarn and in which air under pressure is caused to impinge on the yarn while it travels therethrough, preferably at an angle to the longitudinal axis of the yarn and toward the direction of yarn travel. Working with nylon, for instance, having deniers between around 500 and 2000, which travel from the second godet 19 and through the filament entanglement zone at a rate of about 400 – 500 meters per minute, and working with typical temperatures of between 85° and 185°C, for the first godet 17, and a similar range for the second godet 19, if heated, and utilizing temperatures around 200°C in arcuate member 36, if heated, air pressure in nozzle 50 in the magnitude of approximately 15 pounds per square inch has been successfully used to assure compactness of the fully processed yarn.

It can be appreciated, that the yarn $Y_{1-2}$ will be comprised of two portions of filaments, and unlike yarn $Y_3$ (FIG. 5) where all of the filaments f have approximately the same crimp development, contraction, shrinkage and crimp memory characteristics, yarn $Y_{1-2}$, as diagrammatically depicted in FIG. 5*a*, just prior to entering the yarn entanglement zone will have that portion of the filaments $f_1$ with the lower heat history. It has been noticed, that generally the filaments having the lower heat history lie more or less to the outside of the yarn, it being believed that the higher crimp development characteristics of filaments $f_2$ act to force the filaments $f_1$ outwardly.

FIG. 5*b* is illustrative of yarn $Y_{1-2}$ after it has passed through the filament entanglement zone where the filaments of both portions of the yarn are intertwined for better compactness.

In another embodiment of the invention, yarn $Y_{1-2}$, before dyeing, is woven or tufted into a backing B to form a carpeting pile P (FIG. 6*a*) and the carpeting is then dyed whereby the surface of pile P does not exhibit the "rowiness" characteristic of the pile P′ (on backing B′) of certain conventional carpeting (FIG. 7*a*). Comparing the profile of the pile P (FIG. 6*b*) with the profile of the pile P′ (FIG. 7*b*), it is seen that the tufts of the pile P bend in random direction whereas the tufts of pile P′ are all upright.

It should be understood that many variants in the steps of the process just described may be used for various desired results. For instance, yarn $Y_1$ may be caused to travel around godet 17 four turns while yarn $Y_2$ is traveling through eight turns and the yarns $Y_1$ and $Y_2$ are caused to travel around godet 19 one or two times each. Obviously the residency time in the heating step on godet 17 will depend upon the characteristics of crimp development desired.

The invention can be practiced without an orienting step so that either one of the godets 17 or 19 need not be utilized. This would be the case where already oriented yarn is being processed and an initial heating step is all that is required to condition the yarn for crimping.

It is within the purview of the invention to combine two or more ends of yarn having different crimp characteristics and which have already been oriented and textured. This may be accomplished by combining the textured ends by joining and then advantageously feeding the combined ends through a filament entanglement zone.

As previously noted, where yarns, which have little or no twist, are being processed, and this would more likely be the case where unoriented yarn is sent through the entire process as described above, filament entanglement and/or twisting the combined ends for better tufting, is most desirable.

By a wetting step as described in my copending application Ser. No. 804,622, filed Mar. 5, 1969 and now abandoned the texture may temporarily be removed from at least one of the ends prior to the combining or from the combined end of yarn.

What I claim is:

1. A method of producing a textured yarn from at least two ends of yarn, comprising leading the ends on the run to a heated roller, passing each of the ends around the roller a different number of turns thereby to heat the ends to different extents, and linearly compressing the differently heated ends in a common crimping chamber.

2. A method of producing a textured yarn from at least two ends of yarn comprising heating the ends to different extents and concurrently therewith orienting the ends, and linearly compressing the differently heated ends in a common crimping chamber.

3. The method of claim 2 wherein said heating and orienting is accomplished by leading the ends to a pair of rollers at least one of which is heated and the second of which is driven at a faster rate than the first, passing the ends between said rollers and around and in contact with the same and passing the two ends through a different number of turns on the heated roller, and leading the then oriented and differently heated ends off the second roller to the common crimping chamber and linearly compressing the oriented and differently heated ends.

4. The method of claim 3 including forming a plug of the linearly compressed yarn within the common crimping chamber and transporting the plug through a setting zone, setting the plug of compressed yarn and taking off the combined single end of yarn from the head of the plug.

5. The method of claim 4, including entangling the filaments of the combined single end of yarn.

* * * * *